US008297190B1

(12) United States Patent
Dindl et al.

(10) Patent No.: US 8,297,190 B1
(45) Date of Patent: Oct. 30, 2012

(54) DOOR BREACHING DEVICE WITH RADIALLY EXPANDABLE EXPLOSIVE

(76) Inventors: Frank J Dindl, Newton, NJ (US); Kenneth R Jones, Wayne, NJ (US)

( * ) Notice: Subject to any disclaimer, the term of this patent is extended or adjusted under 35 U.S.C. 154(b) by 408 days.

(21) Appl. No.: 12/721,562

(22) Filed: Mar. 11, 2010

Related U.S. Application Data

(60) Provisional application No. 61/160,410, filed on Mar. 16, 2009.

(51) Int. Cl.
*F42B 12/00* (2006.01)

(52) U.S. Cl. ..... 102/439; 102/430; 102/473

(58) Field of Classification Search ..... 102/430, 102/439, 441, 475, 293, 480, 477
See application file for complete search history.

(56) References Cited

U.S. PATENT DOCUMENTS 3,677,182 A * 7/1972 Peterson ..... 102/517
5,111,746 A * 5/1992 Pentel et al. ..... 102/308
6,408,765 B1 * 6/2002 Tauber et al. ..... 102/499
7,284,490 B1 * 10/2007 Mutascio ..... 102/474
2003/0183114 A1 * 10/2003 Widener ..... 102/502
2011/0174187 A1 * 7/2011 Van Stratum ..... 102/464

* cited by examiner

*Primary Examiner* — Gabriel Klein

(57) ABSTRACT

A cartridge assembly for breaching a door including a cartridge case, a cartridge body, and a fuse. The cartridge case contains a first propellant and a primer. The cartridge body has a rearward end in locking engagement with a forward end of the cartridge case, a channel located in the cartridge body contains an extrudable explosive, a piston in slidable engagement in the channel is in a forward end of said channel, the piston being forward of the extrudable explosive contained in the channel, whereby rearward movement of the piston forces extrudable explosive rearwardly and radially outwardly through extrusion ports into a cavity inside of the cartridge body where a bladder is stowed. The piston has a rearwardly projecting detonator pin which upon movement to a rearward most position engages a rearward escapement and detonator which in turn initiates detonation of explosive in the bladder. A fuse is attached to a forward end of the cartridge body. A proximity fuse or contact fuse may be used.

20 Claims, 11 Drawing Sheets

DOOR BREACHING DEVICE WITH RADIALLY EXPANDABLE EXPLOSIVE

REFERENCE TO RELATED APPLICATION

The present application claims priority of co-pending provisional application Ser. No. 60/160,410, filed Mar. 16, 2009, the entire contents of which is hereby incorporated herein by reference.

BACKGROUND OF THE INVENTION

1. Field of the Invention

The present invention relates in general to a device for quickly removing a door without penetrating the door with a projectile, more particularly, the present invention relates to a cartridge assembly which can be fired from a launcher or gun at a substantial distance from a door to effect rapid and relatively non-destructive knockdown of the door without posing a safety hazard to the operator of the launcher or gun.

2. Description of the Related Art

Israeli Patent No. 106629 teaches a door breaching system which includes a device, illustrated in a side view in FIG. 1, which has a stabilizer body 60 for stabilizing the device during its flight to the proper location, namely, into contact with the object, typically a door, to be removed. Stabilizer body 60 typically includes a tail or wings to aid in aerodynamically stabilizing the launched projectile. Stabilizer body 60 may be of any suitable type including, but not limited to, any of a wide variety of suitable conventional or known stabilizer bodies which can be used in conjunction with various launched grenades, mortars, and the like. The illustrative stabilizer body 60 depicted in FIG. 1 is similar to that commonly used to stabilizer anti-tank projectiles.

This device further includes a shaped explosive charge 62, preferably including high explosive. Explosive charge 62 is shaped to effectively breach the object, e.g., a door, without causing more than minimal damage to persons and property near and beyond the door, when explosive charge 62 is detonated at a preset distance from the door. Preferably, the anterior face of shaped explosive charge 62 is substantially spherical, but many other shapes may be effective, depending largely on the nature and dimensions of the object to be breached, and on the distance from the object at which the explosion is to take place.

Shaped explosive charge 62 is located in a housing 64 designed to allow the force of the explosion to be directed anteriorally rather than posteriorally. Housing 64 may be made of any suitable material, preferably, housing 64 is made of a suitable plastic so as to limit the formation of dangerous shrapnel and thereby minimize potential injuries to personnel on both sides of the door being blasted.

Connected to housing 64, or integrally formed with it, is a stand-off rod 66 of suitable length. Preferably, housing 64 and stand-off rod 66 are two discrete items which are readily connected to each other. Such an arrangement makes it easier to transport the disassembled device with rods 66, housings 64 containing shaped explosive charges 62, and stabilizer 60 housed separately for easy storage and rapid assembly. The connection of stand-off rod 66 to housing 64, when present, may be of any suitable type, including, but not limited to, by screwing or snap-fitting rod 66 into housing 64, and the like. Rod 66 may be made of any suitable material, including, but not limited to, plastic and metal.

The length of stand-off rod 66 and the type, amount and shape of shaped explosive charge 62 are selected to optimize the ability of the device to effectively remove the door, without injuring persons or other property in the vicinity.

Preferably, stand-off rod 66 has connected to its anterior end an impact disc 68 having an effective diameter larger than the effective diameter of standoff rod 66. Impact disc 68 may be integrally formed with stand-off rod 66. Preferably, impact disc 68 is disc-shaped. The presence of impact disc 68 is intended to enlarge the area of direct impact with the door so as to lower the pressure at the point of impact and thus reduce or eliminate the possibility of stand-off rod 66 penetrating the door, thereby reducing the effectiveness of the device and potentially injuring persons and damaging property located beyond the door.

Included in the device is a suitable detonating means for detonating shaped explosive charge 62 substantially upon impact of the anterior end of stand-off rod 68 with the object, e.g., the door.

The detonation can be effected in any of a number of ways, including, but not limited to, by transferring the impact from the stand off rod to a striker which initiates an initiator. The detonation is transferred to a lead pellet 70 which detonates explosive charge 62.

This device also includes a "safe-and-arm" device (SAD) 72 of suitable design which prevents accidental or premature detonation of the device, as is commonly used in various current applications. SAD 72 may, for example, be selected to arm shaped explosive charge 62 only after a pre-selected time period has elapsed after the device has commenced to be propelled toward its target, or after the device has been propelled through a pre-selected distance. SAD 72 may, for example, operate by bringing into alignment initiator and lead pellet 70 and shaped explosive charge 62 only after a certain period of time after launching of the device. SAD 72 prevents the accidental detonation of the device, but typically requires that the device be fired from beyond a certain minimum distance.

To use the device, the operator connects a stand-off rod 66 to housing 64 of shaped explosive charge 62. The operator mounts stabilizer 60 onto a suitable launcher (not shown), such as a grenade launcher or suitable gun. Alternatively, stabilizer body 60 could be replaced by a self-propelling device (not shown), such as that used in RPG rockets. Preferably, however, the device is mounted onto a suitable launcher or gun which provides the propulsion required to deliver the explosive over the relatively short distance between the launcher and target. The operator aims at the optimal point on the object, such as a door, and fires the launcher, propelling the device toward its target.

Upon impact of the anterior end of stand-off rod 66 with the door, the initiator located in SAD 72 detonates pellet 70 (assuming SAD 72 was already armed) which, in turn, immediately sets off shaped explosive charge 62. The created explosion pressure waves spread in a way which depends on the nature, shape and quantity of the explosive used and on the distance from the target at the moment of explosion, which is determined largely by the length of stand-off rod 64.

The device of Israel Patent No. 106629 clearly has many advantages for rapid and relatively non-destructive knocking down of doors. However, given the short ranges over which it is typically used, the device can pose a potential hazard to the device operator and other personnel in his proximity. Specifically, due to the force of the explosion, there is a risk that part or all of stabilizer body 60 may be propelled rearwards at high speed and strike the operator or others nearby.

Thus, there is a need for a device generally similar to the device described above for quickly and effectively breaking down a locked door which will not pose a safety hazard to the operator and other personnel in his vicinity.

U.S. Pat. No. 6,408,765 discloses a door breaching device shown in FIG. 2 which can be used to remotely blow away doors with less risk of damage to the operator or to persons and property near and beyond the door.

FIG. 2 is a side view of such a breaching device, generally designated 30, constructed and operative for controlled blasting of an object at short range.

Breaching device 30 is similar to the device of Israel Patent No. 106629 described above with reference to FIG. 1. Thus, breaching device 74 includes a blasting element 76 including an explosive charge 78 contained within a housing 80. Blasting element 76 is configured to breach the door or other object from a preset distance. Connected to, and extending from, housing 80 is a stand-off rod 82 having a length equal to the preset distance. Typically, standoff rod 82 is connected at its anterior end to an impact disc 84 which has an effective diameter larger than the effective diameter of stand-off rod 82.

The device includes a suitable SAD 88 which prevents accidental or premature detonation of the device, as is commonly used in various known applications. SAD 88 may, for example, be selected to arm shaped explosive charge 78 only after a pre-selected time period has elapsed after the device has commenced to be propelled toward its target, or after the device has been propelled through a pre-selected distance.

A detonator located inside SAD 88 is associated with blasting element 76 and stand-off rod 82, so as to detonate explosive charge 78 substantially upon impact of stand-off rod 82 with the object. Housing 80 preferably contains a lead pellet 86 which transfers the detonation from SAD 88 to explosive charge 78. A tail 90 stabilizes device 74 during its flight to the object.

Tail 90 connected to blasting element 76 through a safety connector 92 is configured to reduce shock forces acting on tail 90 resulting from detonation of explosive charge 78. This serves to diminish the risk of tail 90, or any part thereof, being propelled rearwards in a manner that could cause injury to the operator or other personnel in his vicinity.

Projectiles that radially expand upon impact with a target are known in the art. Many are comprised of a soft deformable material, such as lead, so they undergo some axial compression and radial expansion upon impact. Others are specifically designed to produce radial expansion. One approach taken in the prior art is to include a cavity in the leading end of the projectile, a so-called "hollow point." Another approach includes a cavity in the leading end of the projectile, with a tip or piston in the cavity which is driven into the cavity by the impact with the target, causing radial expansion.

A third approach also includes a cavity. The cavity is filled with a substance or liquid that causes radial expansion. U.S. Pat. No. 5,349,907, Petrovich et al., discloses a projectile with a fluid filled cavity and a shaft disposed in the cavity aft of the fluid. Upon impact, the shaft is driven into the fluid, and compressive pressure on the fluid causes radial expansion. U.S. Pat. No. 3,429,263, Snyder et al., discloses a projectile with a paint-filled cavity that is used for marking targets at a distance. The Snyder patent claims radial expansion of the projectile due to compressive pressure on the paint upon impact.

Rousseau, in U.S. Pat. No. 1,715,788, discloses a hollow point projectile with a cavity, that when filled with fluid by impact with soft tissue, causes radial expansion of the projectile. U.S. Pat. No. 1,512,026, Holden et al., teaches a projectile with a fluid-filled tip attached to the leading end. Upon impact with a target, the compressive pressure on the fluid in the tip is conveyed by a depression in the core of the projectile, or by a jacket that surrounds the core, and causes radial expansion of the projectile.

Prior art projectiles with fluid-filled cavities achieve radial expansion upon impact. However, the Petrovich, Snyder and Holden projectiles each require special manufacture at increased cost. The Rousseau projectile achieves radial expansion only on impact with soft, fluid-rich tissue, a drawback if the projectile strikes boney or thin tissue. These inventions lack a structure and method to mass produce an insert that will create a projectile with consistent expansion properties.

U.S. Pat. No. 7,373,887 discloses a projectile comprising a body having a channel, one or more recesses in the channel, a plunger in the channel, and a fluid in the channel. When the projectile impacts a target, the plunger is driven down the channel, exerting a force on the fluid. The fluid, in turn, exerts fluidic pressure within the recesses, promoting rapid yet predictable expansion of the projectile.

Some projectiles in the art use a cylindrical fluid-filled cavity to exert a radial expanding force. Fluid-filled bullets offer several advantages over hollow-point and ballistic-tip bullets. First, there is no hollow point to clog or malfunction as in a hollow-point bullet. Second, fluid-filled bullets can expand more rapidly than either hollow-point or ballistic-tip bullets. Fluid-filled bullets can offer greater expansion at a given velocity than either a hollow-point or a ballistic-tip bullet.

U.S. Pat. No. 6,675,718 to Parker discloses a method for making a fluid-filled projectile by first assembling a fluid-filled cylinder or capsule, and then inserting the cylinder into a hollow cavity of a bullet.

Despite the potential advantages of fluid-filled projectiles as taught by the prior art, they have had extremely limited to no commercial success. A primary reason for the lack of success is the fact that prior art fluid-filled projectiles exhibit unpredictable and uncontrolled expansion on a round-per-round basis. Predictable expansion is a primary factor when the military, law enforcement agencies, or hunters choose which projectile they are going to use. Accordingly, the military, law enforcement agencies, and hunters have not adopted fluid-filled bullets.

U.S. Pat. No. 1,114,356 to Hoaglund discloses a tip of the bullet fully jacketed. The jacket is made in two parts, a nose portion and a body portion. The nose portion includes longitudinal grooves of a thinner section rearward of the nose itself which promote collapse upon impact. Upon impact, the nose section slides over the rear portion and expands "umbrella-like". Although this concept may serve certain applications, the unsupported rear of the resulting "umbrella" is also likely to collapse under stress. This impairs the ability of the bullet to retain and control sufficient radial expansion. In addition, a more conventional jacket of a single piece is less complex, and is easier and less costly to manufacture.

An early accordian concept employing a single piece jacket is found in U.S. Pat. No. 594,199 to Field. That design, however, lacks any additional means to facilitate nose collapse and expansion. Thus, deformation and expansion depend greatly upon target hardness. In cases of impact only with soft tissue or at slower speeds, the solid nose may well fail to collapse at all. It should be noted that the longated longitudinal holes around the projectile nose of Field are not 'slits', but rather 'cutouts' which are milled or ground into the nose. Their thin, knife-like borders are stated to be for a different purpose, presumably for cutting. Such gaping holes, however, also distort the desired aerodynamically smooth profile and weaken the nose jacket, exposing more soft core material, and rendering the nose more likely to burst or fracture upon impact with harder, honey target material.

U.S. Pat. No. 1,155,901 to Duncan discloses a hard nose insert. Duncan provides no jacket slits nor other means of weakening the jacket to aid or to control radial expansion. It appears that in many situations, no radial expansion would take place. Moreover, upon impact with harder targets, where sufficient force is encountered, the jacket very easily could burst and ramdon expansion or even disintegration ensue. Because the insert is not cylindrical, it would also, apparently, be very difficult to insert into the nose making the bullet more difficult and costly to manufacture.

Thus, it is an object of the present invention to provide a fluid-filled projectile that expands in a predictable manner. Such a projectile would be useful in numerous military and law enforcement applications.

It is another object of the present invention to provide a device for breaching a door which limits and minimizes any danger to the operator or nearby personnel caused by blow back of components or fragments from the device itself.

BRIEF SUMMARY OF THE INVENTION

In an effort to develop a device to achieve the above-described objects, the inventor carried out extensive research, development, and testing of a number of devices. It was unexpectedly discovered during the course of this research that the objects of the present invention could be achieved and even surpassed by employing a device for breaching doors which is in the form of a cartridge assembly. This cartridge assembly includes a cartridge case, a cartridge body having a rearward end in locking engagement with a forward end of the cartridge case and a fuse attached to a forward end of the cartridge body.

In the cartridge assembly of the present invention the cartridge body has a channel located therein which contains an extrudable explosive. A piston in slidable engagement in the channel is positioned forward of the extrudable explosive in the channel. In this arrangement, rearward movement of the piston in the channel forces extrudable explosive rearwardly and radially outwardly so as to fill a bladder stowed in the cartridge body. As the bladder is filled with explosive, it expands radially outwardly considerably beyond and outside of the walls of the cartridge body.

It was unexpectedly discovered that by expanding the explosive outwardly from the cartridge body, that the force of the detonation thereof was enhanced, thereby insuring that the target door would be successfully breached. At the same time, since the explosive detonation takes place not in the cartridge assembly but outside of the cartridge assembly, there is little or no chance that detonation of the explosive will result in any component of the cartridge assembly from flying rearwardly and hitting the operator or any nearby personnel. Thus, the door breaching device of the present invention improves the efficiency of any of the prior art devices used for this purpose as well as providing an extra measure of safety by initiating detonation of an explosive substantially outside of the device carrying the explosive.

In a first embodiment of the present invention there is provided a cartridge assembly for breaching a door without a shaped charge, comprising:

(a) a cartridge case containing a first propellant and a primer in its rearward end for initiating combustion of said first propellant;

(b) a cartridge body having a rearward end in locking engagement with a forward end of said cartridge case, a channel located in the cartridge body, said channel containing an extrudable explosive, a piston in slidable engagement in said channel, said piston positioned in a forward end of said channel, said piston being forward of said extrudable explosive contained in said channel, whereby rearward movement of the piston forces extrudable explosive rearwardly and radially outwardly through extrusion ports into a cavity inside of the cartridge body where a bladder is stowed, said piston having a rearwardly projecting detonator pin which upon movement to a rearward most position engages a rearward escapement and detonator, said rearward escapement and detonator in turn initiates detonation of explosive in the bladder, and (c) a fuse attached to a forward end of said cartridge body, said fuse being connected to a forward escapement which detonates either upon impact or at a pre-selected distance from a door to be breached, said forward escapement initiating combustion of a second propellant positioned forward of said piston, whereby combustion gases from said second propellant force said piston rearwardly which in turn forces explosive in the channel rearwardly and radially outwardly through extrusion ports, thereby filling the bladder with explosive.

In a second embodiment of the present invention there is provided in connection with the cartridge assembly of the first embodiment a device wherein the bladder is stowed in a cavity formed in an outer periphery of the cartridge body.

In a third embodiment of the present invention there is provided in connection with the cartridge assembly of the first embodiment a device wherein a forward end of the cartridge covers the cavity in which the bladder is stowed.

In a fourth embodiment of the present invention there is provided in connection with the cartridge assembly of the second embodiment a device wherein extrusion ports are formed in a rearward wall of said channel, said extrusion ports extending between said channel and said cavity where the bladder is stowed, said bladder walling off said cavity so as to contain explosive being extruded from said channel.

In a fifth embodiment of the present invention there is provided in connection with the cartridge assembly of the first embodiment a device wherein when said bladder is filled with explosive, the bladder extends beyond and outside of said cartridge body.

In a sixth embodiment of the present invention there is provided in connection with the cartridge assembly of the first embodiment a device wherein the fuse is a point detonation fuse which contacts a forward escapement arm moving detonators in-line as the cartridge case impacts a target and then detonates a second propellant which separates the fuse from the cartridge body and generates propellant gases which force said piston and explosive rearwardly, thereby extruding explosive from the channel into said bladder. I suspect we need to elaborate on how the point detonating version works. Propellant charge blows the fuse forward, and blows the projectile body rearward at a relatively low velocity. Pin on the rear of the piston detonates the explosive payload when it reaches the end of it's stroke. Rearward velocity of the projectile body and rearward stroke of the piston provide the separation distance desired for effective door breaching.

In a seventh embodiment of the present invention there is provided in connection with the cartridge assembly of the sixth embodiment a device wherein as explosive fills the bladder and a detonator pin projecting rearwardly from said piston contacts a rear detonator, detonation of an explosive filled bladder is initiated.

In an eighth embodiment of the present invention there is provided in connection with the cartridge assembly of the first embodiment a device wherein said fuse is a proximity fuse which detects when a proper distance from a target door is reached, at which time, said proximity fuse detonates a second propellant forward of said piston which in turn forces said piston and explosive rearwardly in the channel through extrusion ports and into said cavity in which said bladder is stowed, and when said bladder is filled with explosive, and expands outside of the cartridge assembly and said detonator pin on the piston contacts a rearward detonator, the explosive in the bladder is detonated, thereby breaching the target door.

In a ninth embodiment of the present invention there is provided a cartridge body and fuse adapted to be mated with a cartridge case for firing from a launcher or gun, said cartridge body having a forward end of said cartridge case in locking engagement with a fuse, a channel located in said cartridge body, said channel containing an extrudable explosive, a piston in slidable engagement in said channel, said piston positioned in a forward end of said channel, said piston being forward of said extrudable explosive contained in said channel, whereby rearward movement of the piston forces extrudable explosive rearwardly and radially outwardly through extrusion ports into a cavity inside of the cartridge body where a bladder is stowed, said piston having a rearwardly projecting detonator pin which upon movement to a rearward most position engages a rearward escapement and detonator, said rearward escapement and detonator in turn initiates detonation of explosive in the bladder, and said fuse being attached to a forward end of said cartridge body, said fuse being connected to a forward escapement which detonates either upon impact or at a pre-selected distance from a door to be breached, said forward escapement initiating combustion of a second propellant positioned forward of said piston, whereby combustion gases from said second propellant force said piston rearwardly which in turn forces explosive in the channel rearwardly and radially outwardly through extrusion ports, thereby filling the bladder with explosive and expanding the bladder substantially radially outside of the cartridge body.

In a tenth embodiment of the present invention there is provided in connection with the cartridge body and fuse of the ninth embodiment a device wherein the bladder is stowed in a cavity formed in an outer periphery of the cartridge body.

In an eleventh embodiment of the present invention there is provided in connection with the cartridge body and fuse of the ninth embodiment a device wherein a forward end of a cartridge case covers the cavity holding the bladder before the cartridge body is fired.

In a twelfth embodiment of the present invention there is provided in connection with the cartridge body and fuse of the ninth embodiment a device wherein extrusion ports are formed in a rearward wall of said channel, said extrusion ports extending between said channel and said cavity where the bladder is stowed, and said bladder walls off said cavity so as to contain explosive being extruded from said channel.

In a thirteenth embodiment of the present invention there is provided in connection with the cartridge body and fuse of the ninth embodiment a device wherein when said bladder is filled with explosive, the filled bladder extends substantially outside of said cartridge body.

In a fourteenth embodiment of the present invention there is provided in connection with the cartridge body and fuse of the ninth embodiment a device wherein the fuse is a point detonation fuse which contacts a forward escapement arm moving detonators in-line as the cartridge case impacts a target, and then detonates a second propellant which separates the fuse from the cartridge body and generates propellant gases which force said piston and explosive rearwardly, thereby extruding explosive from the channel into said bladder.

In a fifteenth embodiment of the present invention there is provided in connection with the cartridge body and fuse of the ninth embodiment, a device wherein as explosive fills the bladder and a detonator pin projecting rearwardly from said piston contacts a rear detonator, detonation of an explosive filled bladder is initiated.

In a sixteenth embodiment of the present invention there is provided a cartridge body adapted to be mated on a rearward end with a cartridge case and on a forward end with a fuse for breaching a door, said cartridge body having a channel located in the cartridge body, said channel containing an extrudable explosive, a piston in slidable engagement in said channel, said piston positioned in a forward end of said channel, said piston being forward of said extrudable explosive contained in said channel, whereby rearward movement of the piston forces extrudable explosive rearwardly and radially outwardly through extrusion ports into a cavity inside of the cartridge body where a bladder is stowed, said piston having a rearwardly projecting detonator pin which upon movement to a rearward most position engages a rearward escapement and detonator, said rearward escapement and detonator in turn initiates detonation of explosive in the bladder.

In a seventeenth embodiment of the present invention there is provided in connection with the cartridge body of the sixteenth embodiment a device wherein the bladder is stowed in a cavity formed in an outer periphery of the cartridge body.

In an eighteenth embodiment of the present invention there is provided in connection with the cartridge body of the sixteenth embodiment a device wherein before firing, a forward end of a cartridge case covers the cavity in which the bladder is stowed.

In a nineteenth embodiment of the present invention there is provided in connection with the cartridge body of the sixteenth embodiment a device wherein extrusion ports are formed in a rearward wall of said channel, said extrusion ports extending between said channel and said cavity where the bladder is stowed, and said bladder walls off said cavity so as to contain explosive being extruded from said channel.

In a twentieth embodiment of the present invention there is provided in connection with the cartridge body of the sixteenth embodiment a device wherein when said bladder is filled with explosive, the bladder extends radially outwardly beyond and outside of said cartridge body.

BRIEF DESCRIPTION OF THE DRAWINGS

The invention is herein described by way of example, only with reference to the accompanying drawings, wherein.

DETAILED DESCRIPTION OF THE INVENTION

Figure 1:
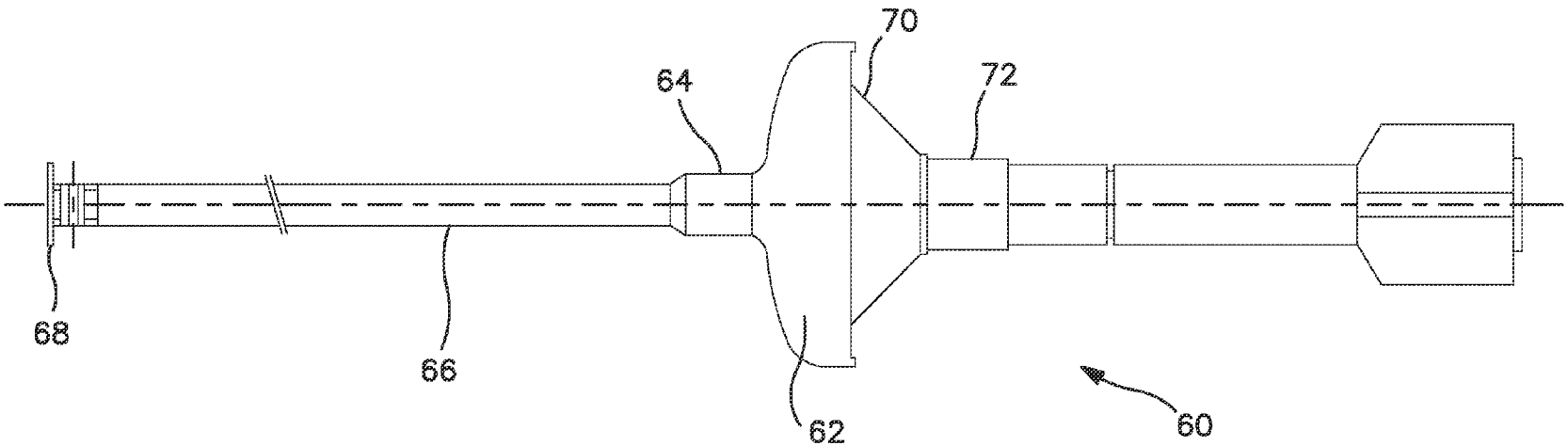
FIG. 1 PRIOR ART
FIG. 1 is a side view of a prior art door breaching device.
Figure 2:
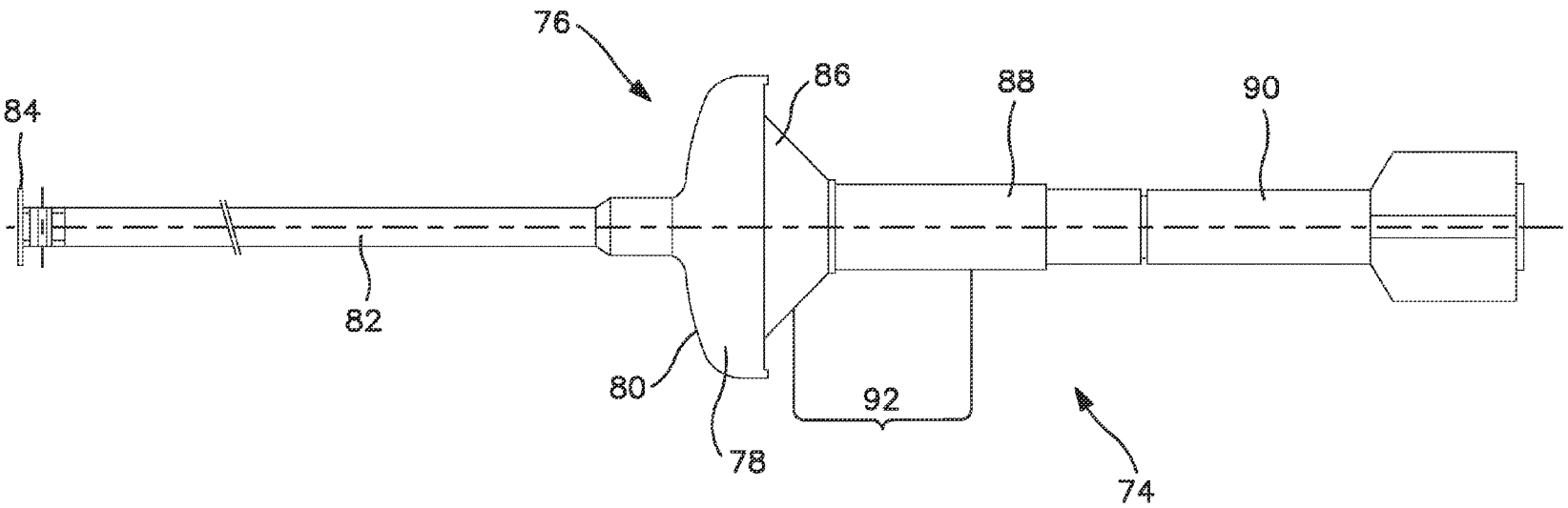
FIG. 2 PRIOR ART
FIG. 2 is a side view of another prior art door breaching device, illustrating in particular a safety connector.
Figure 3:
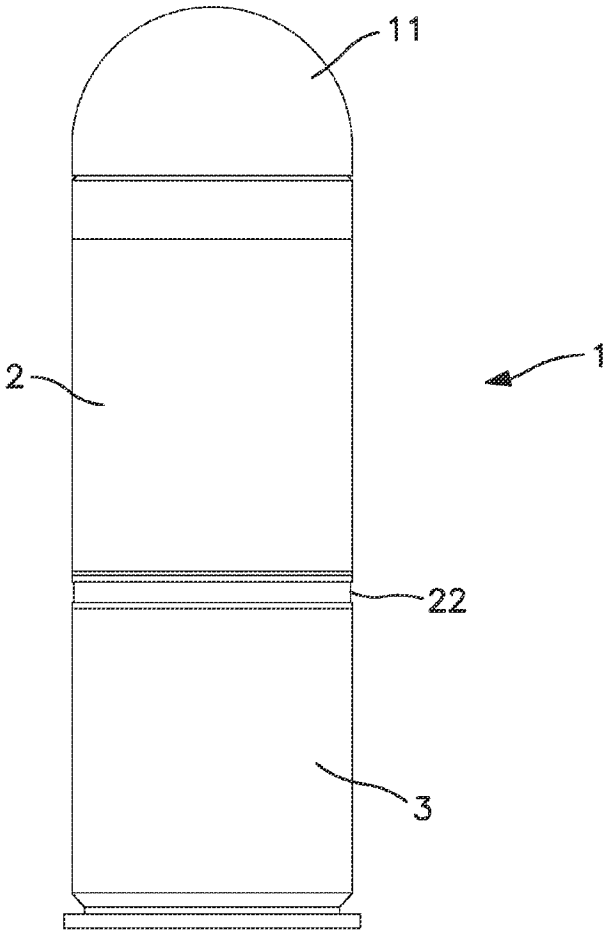
FIG. 3 is a perspective view of an unfired cartridge assembly of the present invention, illustrating the relative position of the cartridge case, cartridge body, and proximity fuse.

The cartridge case assembly for breaching doors of the present invention is in the form of a projectile shown generally at 1 in FIG. 3. The cartridge case assembly 1 comprises a conventional cartridge case 3 incorporating propellant charge 5 and primer 7 in a base thereof for detonation of propellant 5 (FIGS. 3 and 4).

The cartridge case 3 is adapted to be fired from any conventional launcher or gun. A propellant charge 5 is used to propel body 9 and fuse 11 at a velocity of between about 150 and 300 feet per second. This relatively low velocity is due to recoil limitations associated with shoulder fired weapons. This velocity will, however, propel the cartridge case over a distance of at least 50-100 yards. A lip seal 10 is provided between cartridge case 3 and cartridge body 9 (FIG. 4).

Figure 4:
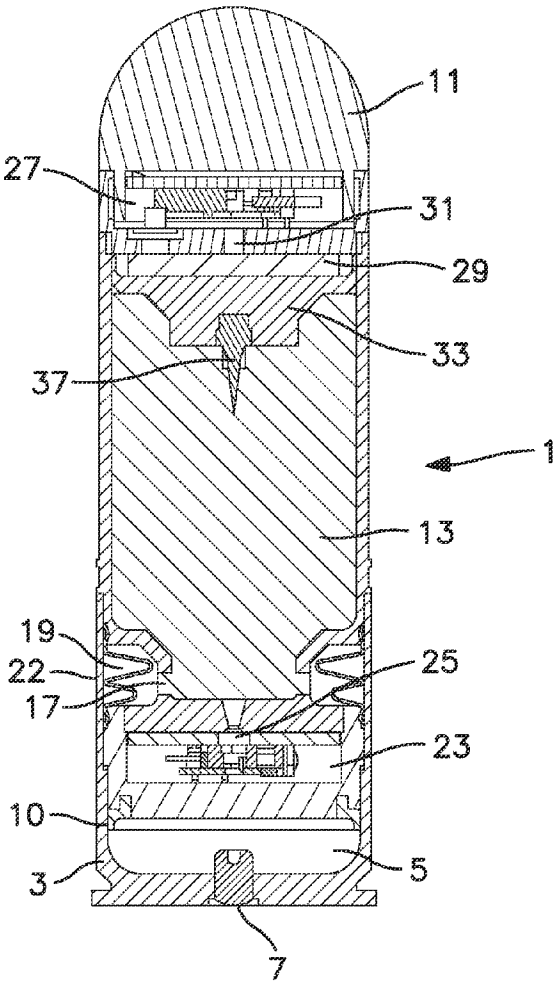
FIG. 4 is a cross-sectional view of an unfired cartridge assembly of the present invention, illustrating the extrudable explosive charge contained in a channel located in the inside of the cartridge body, and a piston which is in slidable engagement in the channel to force extrudable explosive rearwardly and radially outwardly through extrusion ports and into a bladder which is stowed inside the cartridge body.
Figure 11:
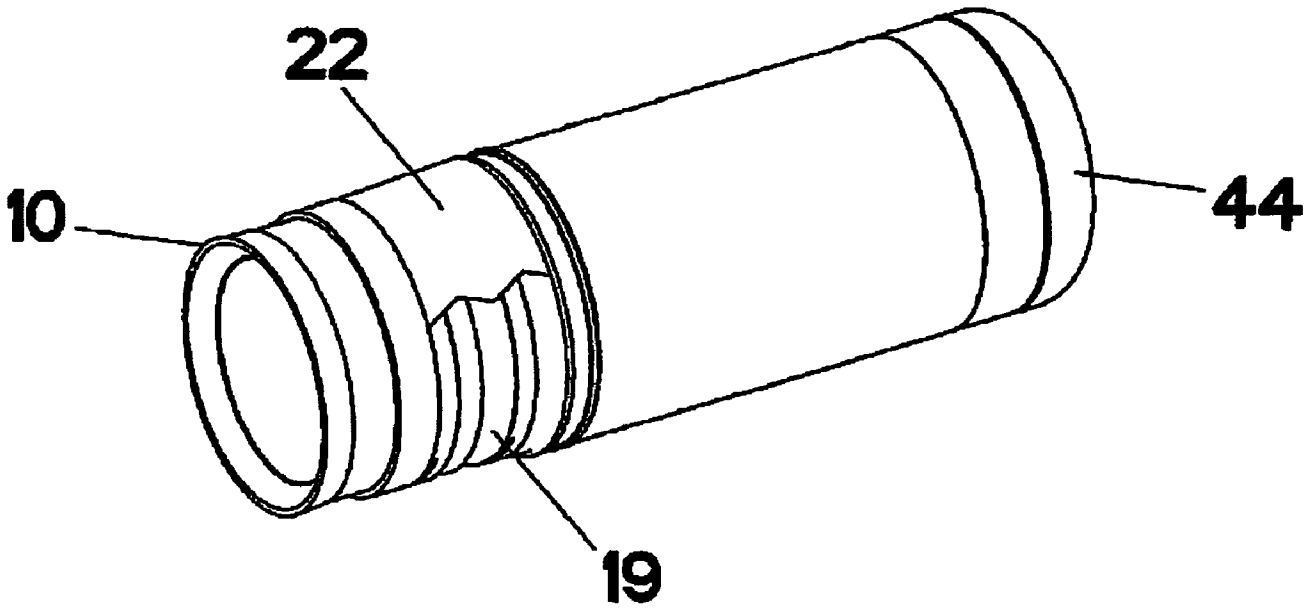
FIG. 11 is a perspective view of a cartridge body and fuse of the present invention, illustrating particularly position of a lip seal and a cover over a cavity in which a bladder is stowed.

The unfired cartridge assembly shown in cross-section in FIGS. 4-10, illustrates the method and apparatus for effecting transfer of an extrudable explosive charge 13 from a channel 14 formed in cartridge body 9, radially outwardly through extrusion ports 17 and then into a bladder 19 stowed in cavity 21. In a preferred embodiment, an outer frangible wall 22 covers cavity 21 (FIGS. 3, 4 and 11). When explosive 13 is extended into bladder 19, wall 22 is ruptured and/or forced away from outer wall of cartridge body 9 by the force of bladder 19 being filled with explosive 13 and pushing outwardly against wall 22.

In another preferred embodiment, a forward end of cartridge case 3 covers cavity 21 in which bladder 19 is stowed as shown in FIG. 4.

Bladder 19 can be formed of either a sheet material or woven material. Suitable sheet materials include sheets formed from thin copper. In a preferred embodiment, suitable woven materials include, for example, rip-stop nylon, Kevlar and similar high strength fabrics.

Cartridge body 9 is provided at its rearward end with a rearward escapement 23 which incorporates detonator 25. A forward end of cartridge body 9 incorporates a forward escapement 27 and a fuse 11 to ignite expansion charge 29. Suitable expansion charges include, for example, smokeless propellants, black powder, sodium azide, and similar gas generators.

An expansion gas seal 31 is provided between piston 33 and forward end 35 of cartridge body 9. Upon detonation of forward expansion charge 29, gas is generated which forces rearwardly piston 33 having a detonator pin 37 projecting rearwardly therefrom (FIGS. 4-10).

The explosive 13 can be in the form of either a liquid or particles capable of being extruded through extrusion ports 17 without detonating. Suitable explosive materials include C4 and other similar plastic explosives. Preferred explosives include C4 and similar extrudable explosives.

In another preferred embodiment, cartridge assembly 1 is a 40 mm projectile which incorporates as the explosive particles of C4 (RDX with a plasticizer added), and a bladder fabricated from rip-stop nylon.

Figure 5:
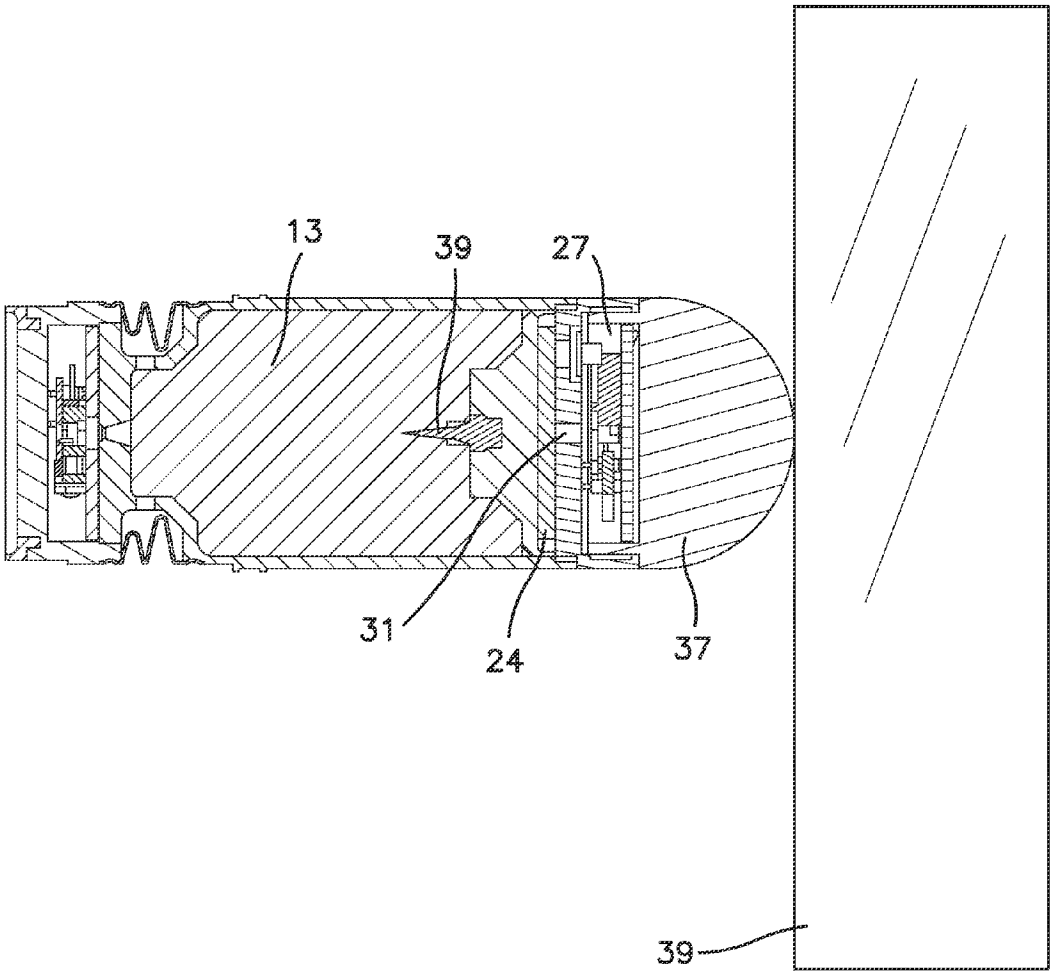
FIG. 5 is a cross-sectional view of a fired cartridge in flight with a point detonating fuse of the present invention, illustrating that when the cartridge is fired, an escapement arm moves a detonator in-line as the cartridge impacts the target.
Figure 6:
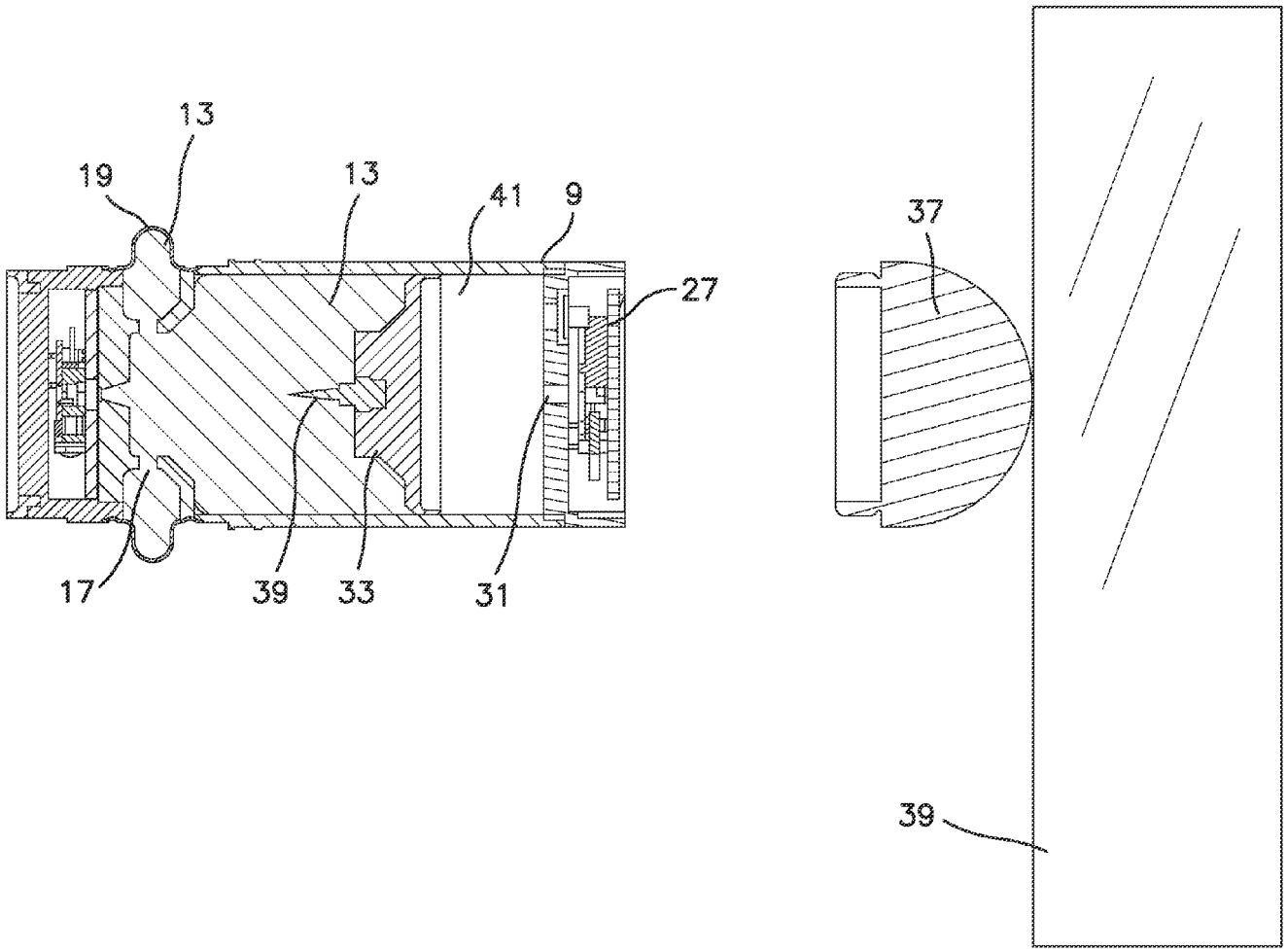
FIG. 6 is a cross-sectional view of a fired cartridge of the present invention, illustrating a firing command initiated-point detonating embodiment having a fuse which upon impact with a target detonates an expulsion charge which pushes the piston rearwardly while separating the fuse from the cartridge body.

In another preferred embodiment, the cartridge assembly 1 of the present invention incorporates a point detonating fuse 37 (FIG. 5). In this embodiment, when the cartridge is fired at target door 39, an upper escapement arm in escapement 27 moves detonators in-line. As the cartridge impacts target 39, fuse 37 detonates an expulsion charge generating an expanding gas 41. An expansion gas seal 31 prevents escape of propellant gases generated as a result of detonation of expansion charge 29.

The expanding gas 41 pushes piston 33 rearwardly (FIG. 6), thus forcing extrudable explosive 13 rearwardly and radially outwardly through extrusion ports 17, thus expanding the bladder as it fills with explosive 13.

Figure 7:
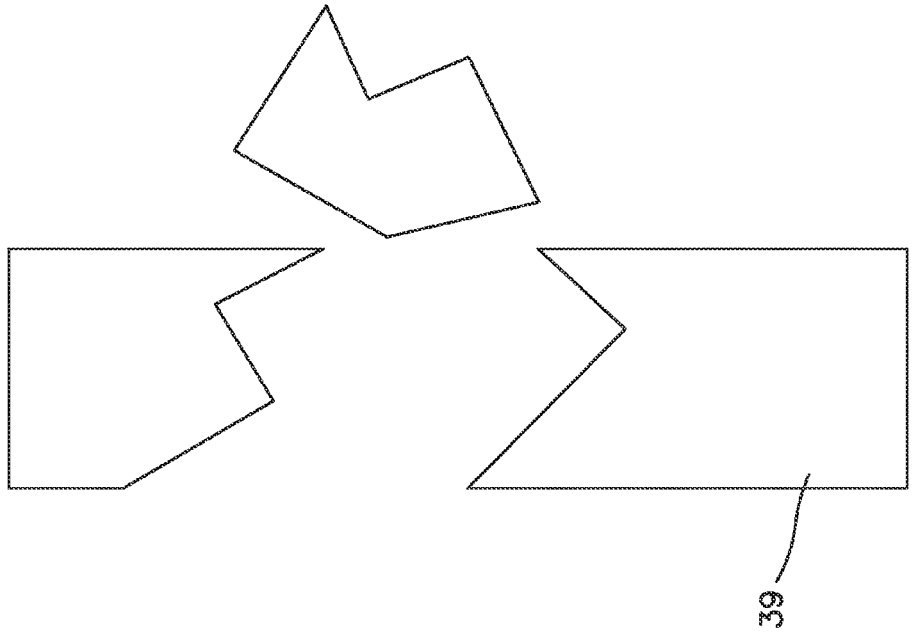
FIG. 7 is a cross-sectional view of the fired cartridge of FIG. 6 of the present invention, illustrating the position of the piston in the cartridge body when the bladder is filled with explosive and the location of the bladder when it is inflated with explosive.
Figure 7:
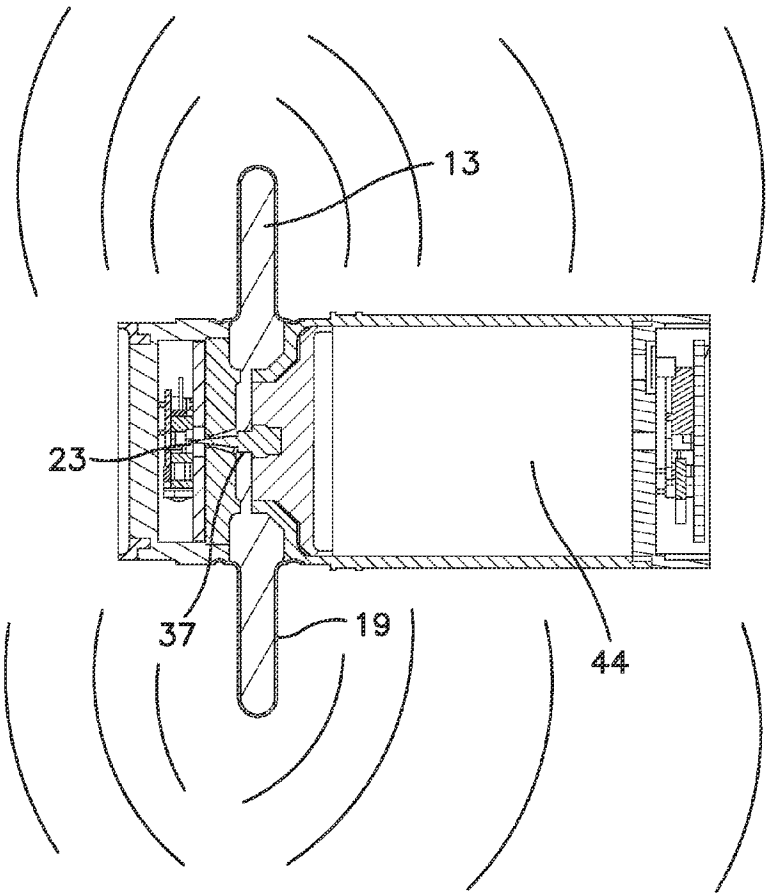

As the bladder 19 is filled with explosive 13 as shown in FIG. 7, piston 33 pushes detonator pin 31 into rear escapement and detonator 23, thus detonating the explosive charge in the bladder which in turn breaches the target door 39 (FIG. 7).

In the preferred embodiment using a point detonating fuse 37, the expansion charge 29 blows the fuse 37 forward, and blows the projectile body 2 rearward at a relatively low velocity. The pin 39 on the rear of the piston 33 detonates the explosive payload 13 when the pin 39 reaches the end of it's stroke. The resultant rearward velocity of the projectile body 2 and rearward stroke of the piston 33 provide the separation distance desired for effective door breaching.

Figure 8:
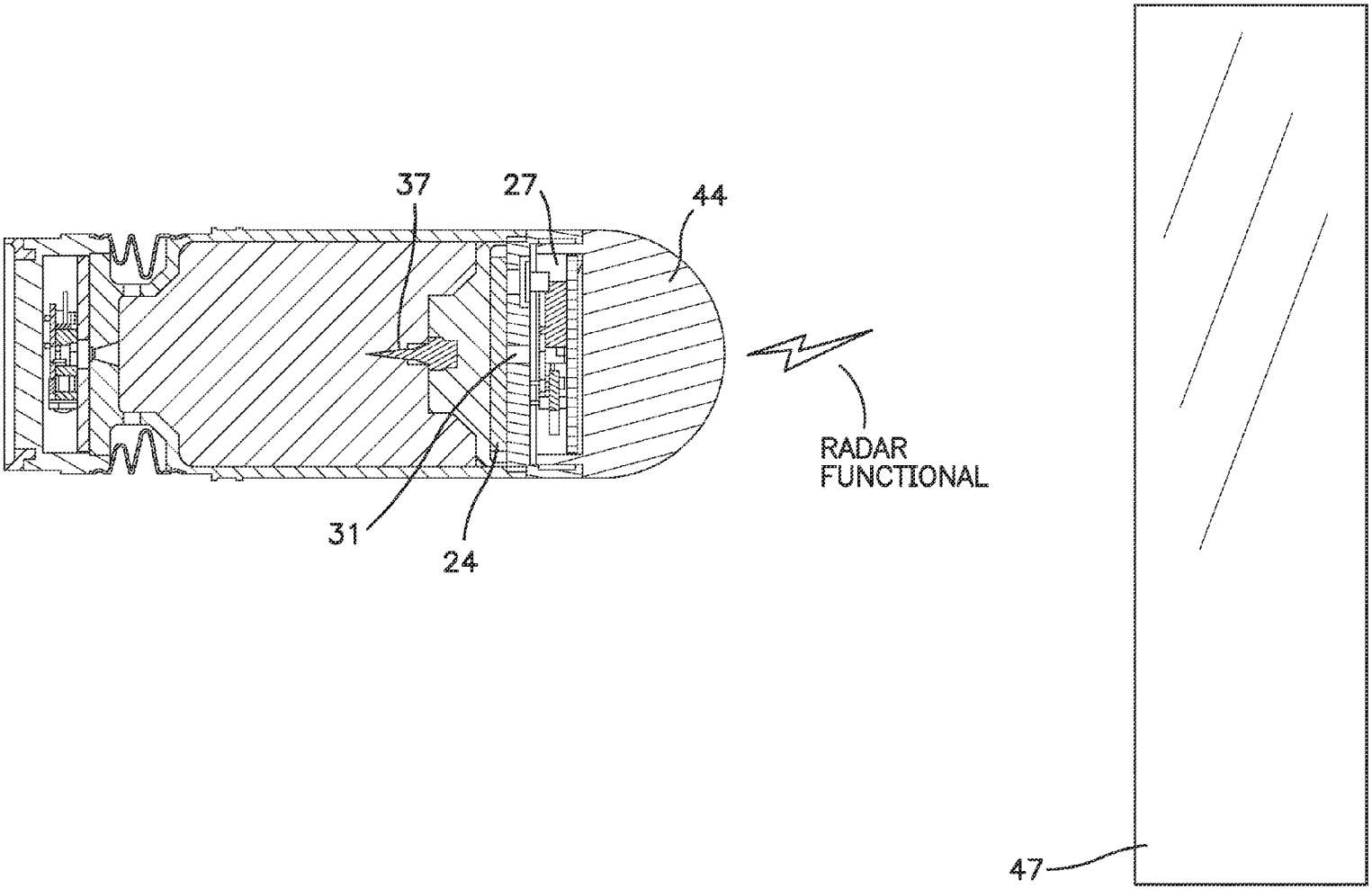
FIG. 8 is a cross-sectional view of a fired cartridge in flight of the present invention, illustrating particularly a proximity fuse detection of the target at a proper distance.

In a preferred embodiment, a radar functional proximity fuse 44 is used on a forward end of cartridge assembly 1 as shown in FIGS. 8-11. FIG. 8 shows the fired cartridge in flight equipped with proximity fuse 44. As the cartridge is fired at target door 47, an escapement arm 27 moves detonators in-line. When proximity fuse 44 is at a predetermined distance from the target and detects the target, fuse 44 then initiates a firing train sequence including ignition of expansion charge 29. This initiates generation of expansion gases from forward propellant charge 29 (FIG. 8).

Figure 9:
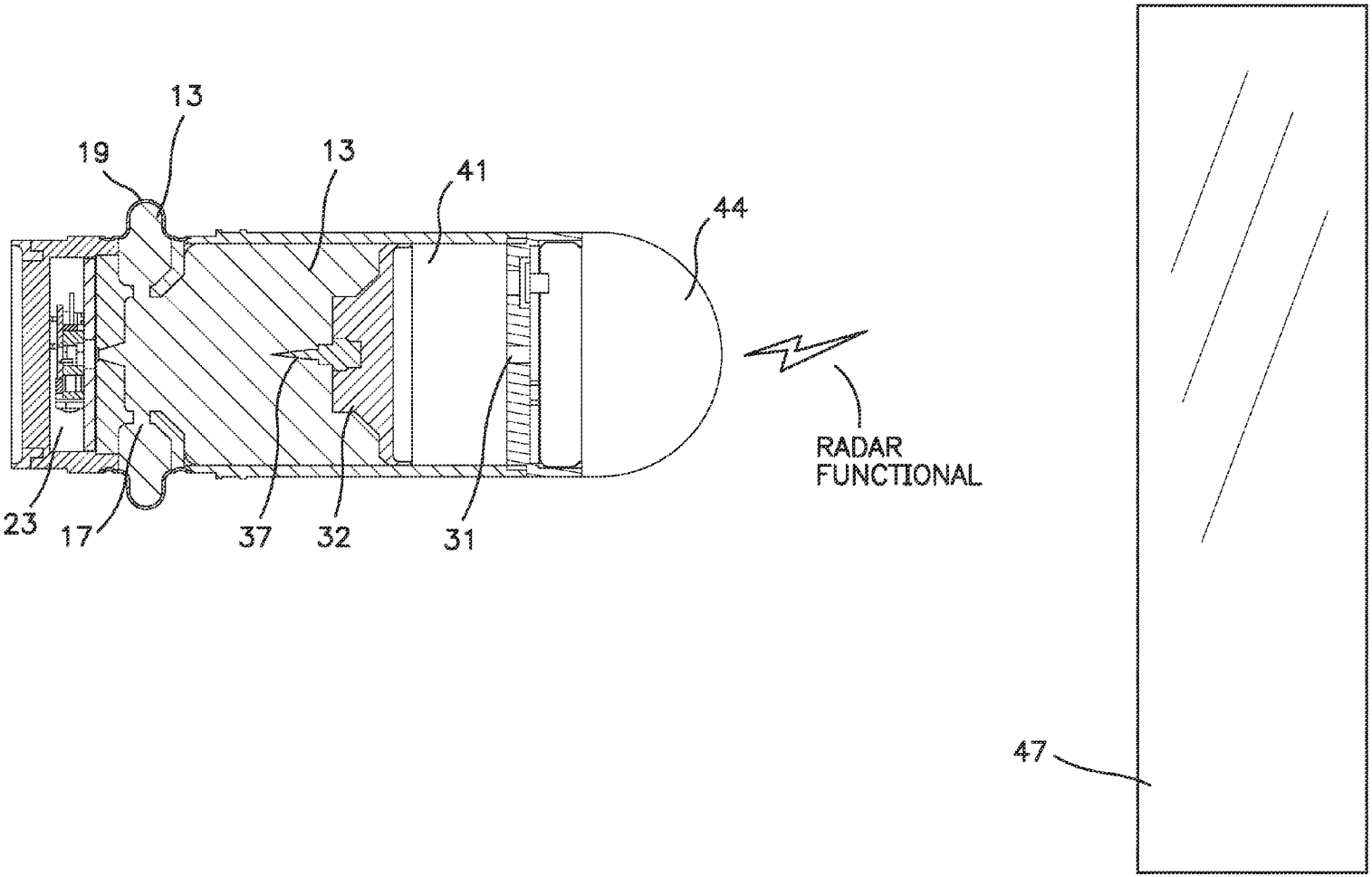
FIG. 9 is a cross-sectional view of a fired cartridge firing command initiated-proximity fuse embodiment shown in FIG. 8, illustrating particularly the extrusion of explosive into the bladder when the fired cartridge approaches the target.
Figure 10:
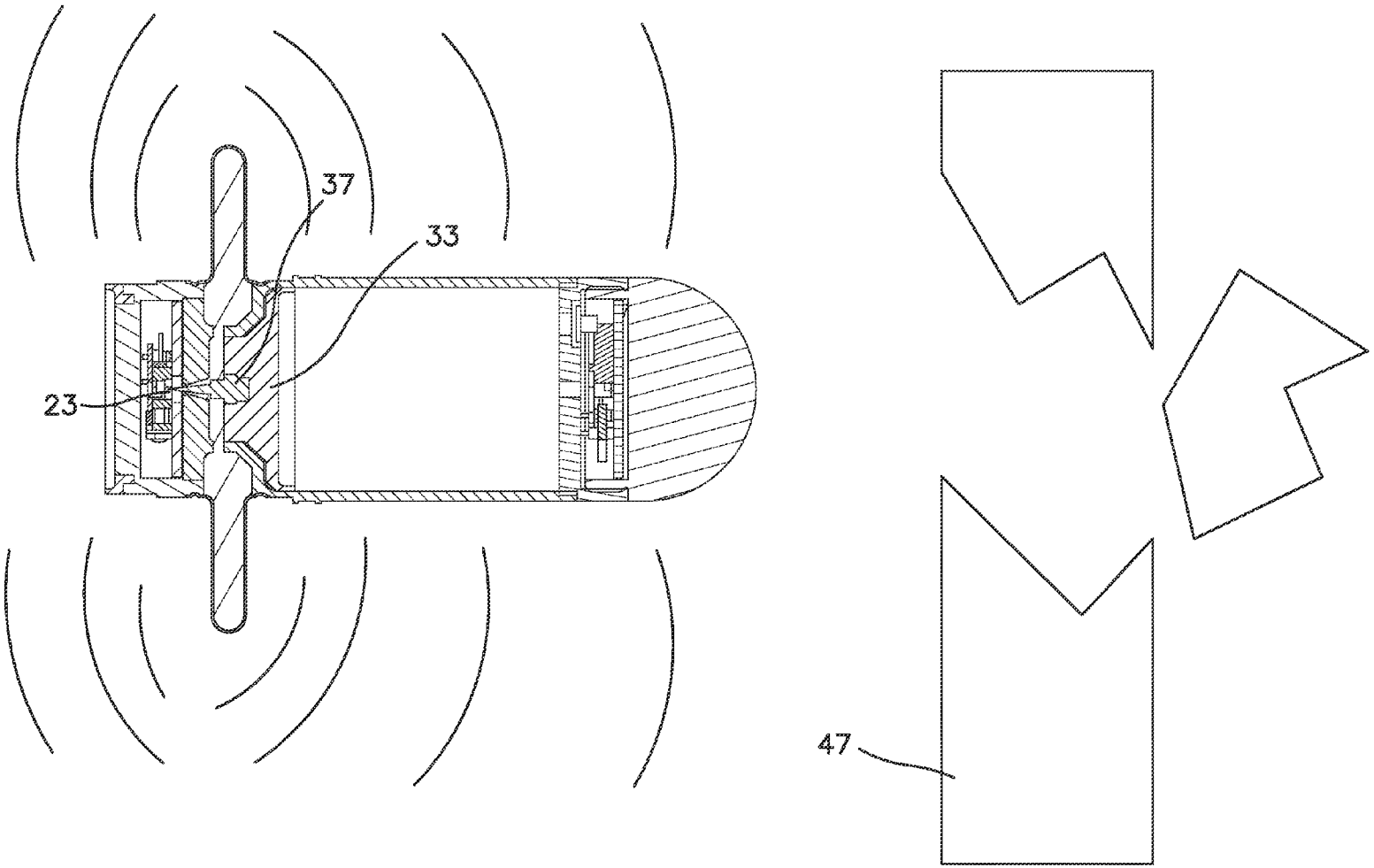
FIG. 10 is a cross-sectional view of the fired cartridge having a proximity fuse of the present invention as shown in FIG. 9, illustrating particularly the full inflation of the bladder with explosive immediately before detonation.

As the cartridge continues in its flight to target 47, expanding gas 41 pushes piston 33 rearwardly, forcing explosive 13 rearwardly and radially outwardly through extrusion ports 17 and into bladder 19 (FIG. 9). As the bladder begins to fill with explosive, the rearward detonator 23 is fired at a proper distance from target 47.

Ideally, when cartridge 1 reaches an optimum distance between 6 and 18 inches from target 47, bladder 19 is filled with explosive 13, the piston 33 pushes detonator pin into rear detonator 23, thus detonating explosive in the bladder which in turn breaches the target door 47.

Although specific embodiments of the present invention have been disclosed herein, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

LIST OF DRAWING ELEMENTS

1: projectile/cartridge case assembly
3: cartridge case
5: propellant charge
7: primer
9: cartridge body
10: lip seal
11: fuse
13: extrudable explosive charge
14: channel
17: extrusion ports
19: bladder
21: cavity
22: outer frangible wall
23: rearward escapement
25: detonator
27: forward escapement/escapement arm
29: expansion charge
31: expansion gas seal
33: piston
35: forward end
37: detonator pin
39: target door
41: expanding gas
44: radar functional proximity fuse
47: target door
60: stabilizer body
62: shaped explosive charge
64: housing
66: stand-off rod
68: impact disc
70: lead pellet
72: "safe-and-arm" device
74: breaching device 7
76: blasting element
78: explosive charge
80: housing
82: stand-off rod
84: impact disc
88: SAD 88
90: tail
92: safety connector

What is claimed is:

1. A cartridge assembly for breaching a door without a shaped charge, comprising:

(a) a cartridge case containing a first propellant and a primer in its rearward end for initiating combustion of said first propellant;

(b) a cartridge body having a rearward end in locking engagement with a forward end of said cartridge case, a channel located in the cartridge body, said channel containing an extrudable explosive, a piston in slidable engagement in said channel, said piston positioned in a forward end of said channel, said piston being forward of said extrudable explosive contained in said channel, whereby rearward movement of the piston forces extrudable explosive rearwardly and radially outwardly through extrusion ports into a cavity inside of the cartridge body where a bladder is stowed, said piston having a rearwardly projecting detonator pin which upon movement to a rearward most position engages a rearward escapement and detonator, said rearward escapement and detonator in turn initiates detonation of explosive in the bladder, and (c) a fuse attached to a forward end of said cartridge body, said fuse being connected to a forward escapement which detonates either upon impact or at a pre-selected distance from a door to be breached, said forward escapement initiating combustion of a second propellant positioned forward of said piston, whereby combustion gases from said second propellant force said piston rearwardly which in turn forces explosive in the channel rearwardly and radially outwardly through extrusion ports, thereby filling the bladder with explosive.

2. The cartridge assembly of claim 1, wherein the bladder is stowed in a cavity formed in an outer periphery of the cartridge body.

3. The cartridge assembly of claim 1, wherein a forward end of the cartridge case covers the cavity in which the bladder is stowed.

4. The cartridge assembly of claim 2, wherein extrusion ports are formed in a rearward wall of said channel, said extrusion ports extending between said channel and said cavity where the bladder is stowed, said bladder walling off said cavity so as to contain explosive being extruded from said channel.

5. The cartridge assembly of claim 1, wherein when said bladder is filled with explosive, the bladder extends beyond and outside of said cartridge body.

6. The cartridge assembly of claim 1, wherein the fuse is a point detonation fuse which contacts a forward escapement arm moving detonators in-line as the cartridge case impacts a target, and then detonates a second propellant which separates the fuse from the cartridge body and generates propellant gases which blows the fuse forward and the cartridge body rearward to create the desired standoff distance at the moment of detonation, said second propellant forcing said piston and explosive rearwardly and radially outwardly, thereby extruding explosive from the channel into said bladder.

7. The cartridge assembly of claim 6, wherein as explosive fills the bladder and a detonator pin projecting rearwardly from said piston contacts a rear detonator, detonation of an explosive filled bladder is initiated.

8. The cartridge assembly of claim 1, wherein said fuse is a proximity fuse which detects when a proper distance from a target door is reached, at which time, said proximity fuse detonates a second propellant forward of said piston which in turn forces said piston and explosive rearwardly in the channel through extrusion ports and into said cavity in which said bladder is stowed, and when said bladder is filled with explosive, and said detonator pin on the piston contacts a rearward detonator, the explosive in the bladder is detonated, thereby breaching the target door.

9. A cartridge body and fuse adapted to be mated with a cartridge case for firing from a launcher or gun comprising:

a cartridge body having:

a forward end of said cartridge case in locking engagement with a fuse;

a channel located in said cartridge body, said channel containing an extrudable explosive;

a piston in slidable engagement in said channel, said piston positioned in a forward end of said channel, said piston being forward of said extrudable explosive contained in said channel;

whereby rearward movement of the piston forces extrudable explosive rearwardly and radially outwardly through extrusion ports into a cavity inside of the cartridge body where a bladder is stowed, said piston having a rearwardly projecting detonator pin which upon movement to a rearward most position engages a rearward escapement and detonator, said rearward escapement and detonator in turn initiates detonation of explosive in the bladder; and a fuse being attached to a forward end of said cartridge body, said fuse being connected to a forward escapement which detonates either upon impact or at a pre-selected distance from a door to be breached, said forward escapement initiating combustion of a second propellant positioned forward of said piston, whereby combustion gases from said second propellant force said piston rearwardly which in turn forces explosive in the channel rearwardly and radially outwardly through extrusion ports, thereby filling the bladder with explosive and expanding the bladder substantially outside of the cartridge body.

10. The cartridge body and fuse of claim 9, wherein the bladder is stowed in a cavity formed in an outer periphery of the cartridge body.

11. The cartridge body and fuse of claim 9, wherein a forward end of a cartridge case covers the cavity holding the bladder.

12. The cartridge body and fuse of claim 9, wherein extrusion ports are formed in a rearward wall of said channel, said extrusion ports extending between said channel and said cavity where the bladder is stowed, and said bladder walls off said cavity so as to contain explosive being extruded from said channel.

13. The cartridge body and fuse of claim 9, wherein when said bladder is filled with explosive, the filled bladder extending substantially outside of said cartridge body.

14. The cartridge body and fuse of claim 9, wherein the fuse is a point detonation fuse which contacts a forward escapement arm moving detonators in-line as the cartridge case impacts a target and then detonates a second propellant which separates the fuse from the cartridge body and generates propellant gases which blows the fuse forward and the cartridge body rearward to create the desired standoff distance at the moment of detonating gases from said second propellant force said piston and explosive rearwardly, thereby extruding explosive from the channel into said bladder.

15. The cartridge body and fuse of claim 9, wherein as explosive fills the bladder and when a detonator pin projecting rearwardly from said piston contacts a rear detonator, whereby detonation of an explosive filled bladder is initiated.

16. A cartridge body adapted to be mated on a rearward end with a cartridge case and on a forward end with a fuse for breaching a door, said cartridge body having a channel located in the cartridge body, said channel containing an extrudable explosive, a piston in slidable engagement in said channel, said piston positioned in a forward end of said channel, said piston being forward of said extrudable explosive contained in said channel, whereby rearward movement of the piston forces extrudable explosive rearwardly and radially outwardly through extrusion ports into a cavity inside of the cartridge body where a bladder is stowed, said piston having a rearwardly projecting detonator pin which upon movement to a rearward most position engages a rearward escapement and detonator, said rearward escapement and detonator in turn initiates detonation of explosive in the bladder.

17. The cartridge body of claim 16, wherein the bladder is stowed in a cavity formed in an outer periphery of the cartridge body.

18. The cartridge body of claim 16, wherein a frangible cylindrical section forms an outer peripheral wall of a portion of the cartridge body to cover the cavity holding the bladder.

19. The cartridge body of claim 16, wherein extrusion ports are formed in a rearward wall of said channel, said extrusion ports extending between said channel and said cavity where the bladder is stowed, and said bladder walls off said cavity so as to contain explosive being extruded from said channel.

20. The cartridge body of claim 16, wherein when said bladder is filled with explosive, the bladder extends radially outwardly beyond and outside of said cartridge body.

* * * * *